US008291930B2

(12) United States Patent
Lee

(10) Patent No.: US 8,291,930 B2
(45) Date of Patent: Oct. 23, 2012

(54) HOT WATER SYSTEM

(76) Inventor: Yu-Tuan Lee, Taipei (TW)

( * ) Notice: Subject to any disclaimer, the term of this patent is extended or adjusted under 35 U.S.C. 154(b) by 830 days.

(21) Appl. No.: 12/424,245

(22) Filed: Apr. 15, 2009

(65) Prior Publication Data

US 2009/0266426 A1 Oct. 29, 2009

(30) Foreign Application Priority Data

Apr. 29, 2008 (TW) ..... 97115778 A

(51) Int. Cl.
*F16K 49/00* (2006.01)

(52) U.S. Cl. ..... 137/337; 137/624.12; 236/12.13; 236/46 F

(58) Field of Classification Search ..... 137/337, 137/624.12; 236/12.11–12.13, 46 F; 62/158
See application file for complete search history.

(56) References Cited

U.S. PATENT DOCUMENTS 4,697,614 A * 10/1987 Powers et al. ..... 137/337
4,832,258 A * 5/1989 Hoshino et al. ..... 236/13
4,945,942 A * 8/1990 Lund ..... 137/337
5,205,318 A * 4/1993 Massaro et al. ..... 137/337
5,261,443 A * 11/1993 Walsh ..... 137/337
5,918,625 A 7/1999 Ziehm
6,895,985 B2 5/2005 Popper et al.
7,140,382 B2 11/2006 Kempf et al.

FOREIGN PATENT DOCUMENTS

TW M322522 U 11/2007
TW M322525 U 11/2007

* cited by examiner

*Primary Examiner* — Eric Keasel
(74) *Attorney, Agent, or Firm* — Birch, Stewart, Kolasch & Birch, LLP

(57) ABSTRACT

A hot water system includes cold water pipes, hot water pipes, a water heater, a pump, a pump control unit and a connection valve unit. The pump is used to increase the pressure of the hot water pipes to a preset higher level than the pressure in the cold water pipes. When hot water is needed, the connection valve unit at the user side is opened to connect the cold water pipes and the hot water pipes, and when the cold water pipes and the hot water pipes are connected, the water pressure difference between them will become smaller. When the pressure difference change is detected, the pump control unit will activate the pump to pump the water in the hot water pipes into the cold water pipes, so the water in the pipes starts to circulate, and the water will flow through the water heater and will be heated. When the heated hot water reaches the user, the pump is stopped. After the hot water is being served or when the water temperature drops down, the pump is again put into normal operation.

19 Claims, 4 Drawing Sheets

HOT WATER SYSTEM

CROSS REFERENCE TO RELATED APPLICATIONS

This Non-provisional application claims priority under 35 U.S.C. §119(a) on Patent Application No(s). 097115778 filed in Taiwan, Republic of China on Apr. 29, 2008, the entire contents of which are hereby incorporated by reference.

BACKGROUND OF THE INVENTION

1. Field of Invention

This invention relates to a hot water system which uses the cold and hot water recirculation to provide a fast hot water supply and avoid the waste of water.

2. Related Art

Conventional domestic hot water supply system uses a water heater to heat up the water from the cold water pipes, and flows to the fixtures through hot water pipes, such as the faucets in the bathroom or kitchen. When using the hot water at the first time, there is a lot of cold water in the hot water pipes, the user has to open the faucet and drain the cold water before he gets the hot water. The user has to wait and the water is wasted. As for this water wasting problem, there are many inventions designed to solve this problem.

One of the most common hot water recirculation system at present time uses a pump installed under the sink, the pump inlet is connected to the hot water pipe under the sink, and its outlet is connected to the cold water pipe, the user has to push a start button to start the pump, and the cold water in the hot water pipes will be pumped into the cold water pipes and start the recirculation, when the recirculated water is heated by the water heater and returns to the pump through the hot water pipes, on the detection of a rising of water temperature, the pump will be stopped, and the user can now open the faucet and use the hot water. An example product is provided by the Dux Manufacturing Limited called READYHOT. But this kind of solution must install a pump under every sink that needs fast hot water, and for a shower room faucet there are problems in installation space and in the power supply safety.

There are other more complicated hot water supply systems, but most of them require the installation of a complicated control valves (for example, the U.S. Pat. No. 7,140,382), and some have to change the piping system layout (for example, U.S. Pat. No. 6,895,985 and U.S. Pat. No. 5,918,625). These solutions are basically not particle for an already built house.

SUMMARY OF THE INVENTION

Regarding the above-mentioned problems, it is an objective of the invention to provide an apparatus, which can provide a water recirculation without changing the layout of water piping systems. Thus, the user can enjoy fast hot water supply as well as saving the water. In this invention, there are cold water pipes, hot water pipes, a water heater, a pump, a pump control unit and a mix faucet with an outlet control valve. In the conventional water piping system, the cold water pipes connect to the water heater's inlet, and the hot water pipes connect to the water heater's outlet. The invention inserts a pump between the cold water pipes and the water heater, the pump control unit controls the pump to increase the water pressure in the hot water pipes, and the water pressure is kept at a higher preset level than the water pressure of the cold water pipes. The fixtures at the terminals of the piping system, which connects to both the cold water pipes and hot water pipes (such as the mix faucet with an outlet control valve), is used to form a closed channel for connecting the cold water pipes and the hot water pipes, and so to form a recirculation path. With the pump control unit which can detect the water pressure difference and the water temperature, and by detecting the water pressure difference change when the cold water pipes and hot water pipes are connected, the pump is controlled and able to recirculate the water in the pipes until the hot water is available.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
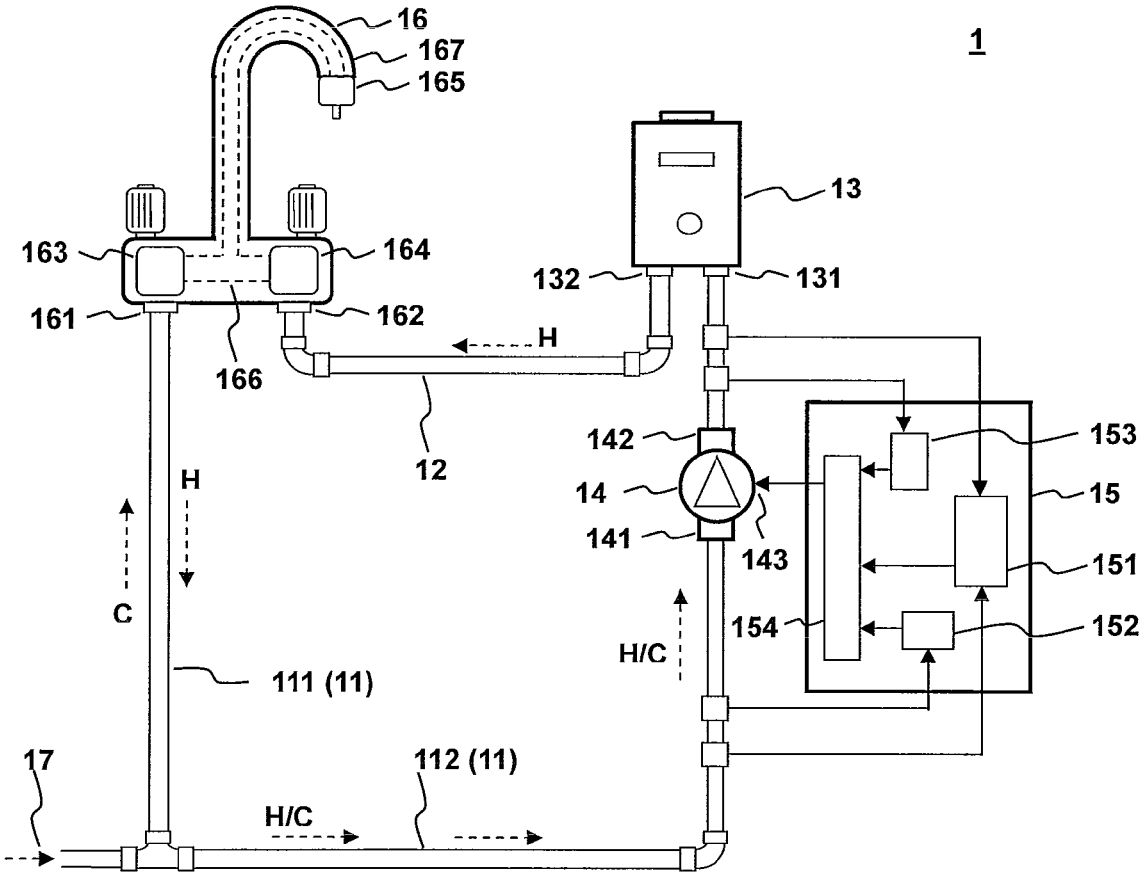
FIG. 1 is a system diagram showing a hot water system according to a preferred embodiment of the invention.

Referring to FIG. 1, the hot water system of the invention consists of cold water pipes 11, hot water pipes 12, a water heater 13, a pump 14, a pump control unit 15, a mix faucet 16 and water mains 17. The water heater 13 has a cold water inlet 131 and a hot water outlet 132. The pump 14 has a water inlet 141, a water outlet 142 and a power supply input 143. The pump control unit 15 has a water pressure detector 151, a water temperature detector 152, a water flow detector 153 and a pump control circuit 154. The mix faucet 16 has a cold water inlet 161, a hot water inlet 162, a cold water control valve 163, a hot water control valve 164, an outlet control valve 165, a water outlet 167 and a water mix chamber 166. The hot water inlet 162 connects to the hot water pipes 12, and the cold water inlet 161 connects to the cold water pipes 11. The outlet control valve 165 can stop the water in the mix faucet 16 from flowing out of the water outlet 167, and force the water from the hot water pipes 12 to flow back into the cold water pipes 11 through the water mix chamber 166 of the mix faucet 16. The pump 14 increases the water pressure in the hot water pipes 12 and makes the water pressure higher than the water pressure in the cold water pipes 11. The cold water pipes include a first cold water pipe 111 and a second cold water pipe 112. The first cold water pipe 111 connects to the cold water inlet 161, and the second cold water pipe 112 connects to the pump 14 and the first cold water pipe 111. The hot water outlet 132 of the water heater 13 connects to hot water pipes 12, the cold water inlet 131 of the water heater 13 connects to the water outlet 142 of the pump 14, the inlet 141 of the pump 14 connects to cold water pipes 11, the water pressure detector 151 of the pump control unit 15 connects to the water inlet 141 and the water outlet 142 of the pump 14, the water temperature detector 152 connects to the water inlet 141 of the pump 14, the water flow detector 153 connects to the water outlet 142 of the pump 14, the inputs of the pump control circuit 154 connect to the outputs of the water pressure detector 151, the water temperature detector 152 and the water flow detector 153, the output of the pump control circuit 154 connects to the power supply input 143 of the pump 14, the cold water inlet 161 of the mix faucet 16 connects to the cold water pipes 11, the hot water inlet 162 of the mix faucet 16 connects to the hot water pipes 12, and the cold water pipes 11 connects to the mains 17.

Referring to FIG. 1, in the embodiment, the pump control unit 15 controls the pump 14 to increase the water pressure of the hot water pipes 12, and to keep the water pressure difference between the hot water pipe 12 and cold water pipe 11 at a preset value. When the cold water control valve 163 and the hot water control valve 164 of the mix faucet 16 are both opened, and the outlet control valve 165 is closed, the water from the cold water pipes 11 and hot water pipes 12 will be injected into and mixed in the water mix chamber 166, as a result the cold water pipes 11 and hot water pipes 12 will be connected and their water pressure difference will be decreased. When the water pressure detector 151 detects the water pressure difference drop, the pump control unit 15 will start the pump 14 to increase the water pressure in the hot water pipes 12, as a result the water in the hot water pipes 12 will flow into the cold water pipes 11 through the water mix chamber 166, and flow back to the pump 14 to form a recirculation. The recirculated water will flow through the water heater 13 and will be heated to become hot water, the hot water will flow to the mix faucet 16 and to the cold water pipes 11 and finally to the pump 14. When the water temperature detector 152 detects that the water temperature starts to rise at the pump 14, the pump control unit 15 will stop the pump 14 to stop the water recirculation, and waits for the user to use the hot water in the hot water pipes 12. When the user opens the outlet control valve 165 of the mix faucet 16 to use the hot water, the cold water from the mains 17 will flow through the cold water pipes 11 to the mix faucet 16 and the pump 14. When the water flow detector 152 detects that water is flowing from the water inlet 141 to the water outlet 142 of the pump 14, or when the water temperature detector 152 detects the water temperature has dropped to a certain level, the pump control unit 15 will start the pump again to increase the water pressure of the hot water pipes 12 or start the recirculation again to re-heat the water in the pipes.

Furthermore, the outlet control valve 165 can be a temperature controlled valve which will open when the water temperature rises. When the outlet control valve 165 is closed and the water recirculation starts, the heated water will flow by the outlet control valve 165, by using a temperature controlled mechanism the outlet control valve 165 can be opened automatically to let the hot water flow out of the water outlet 167, and so when the water recirculation is started and the heated hot water arrives the mix faucet 16, the hot water will be automatically released by the outlet control valve 165 through the water outlet 167, and the water recirculation will be stopped, the user can then uses the hot water, also preventing the hot water from entering the cold water pipes 11.

Referring to FIG. 1, in the embodiment, the pump control unit 15 can further include an operating time control function, which can protect the pump 14 from endless recirculation condition when the water heater 13 is not working or when the hot water pipes 12 are having a leak. The operation time control function can further be used to set the time limit for every recirculation operation to prevent too much hot water from flowing into the cold water pipes 11.

Furthermore, the water heater 13 can be designed to output a lower temperature warm water at the beginning of the heating process, the lower temperature warm water has a higher temperature than the cold water, but it will not damage the cold water pipes which are mostly made of PVC (for example, a 40 degree C. warm water), and uses a timer to calculate the lower temperature warm water's travel time from leaving the water heater 13's outlet to back to the water heater 13's inlet, after the traveling time is obtained, the water heater 13 can then start to power up to heat the water to a preset high temperature and start to count the time until about half of the obtained traveling time, by then the high temperature hot water should be able to travel to the faucet of the user, and now the water recirculation can be stopped and wait for the user to use the hot water.

Figure 2:
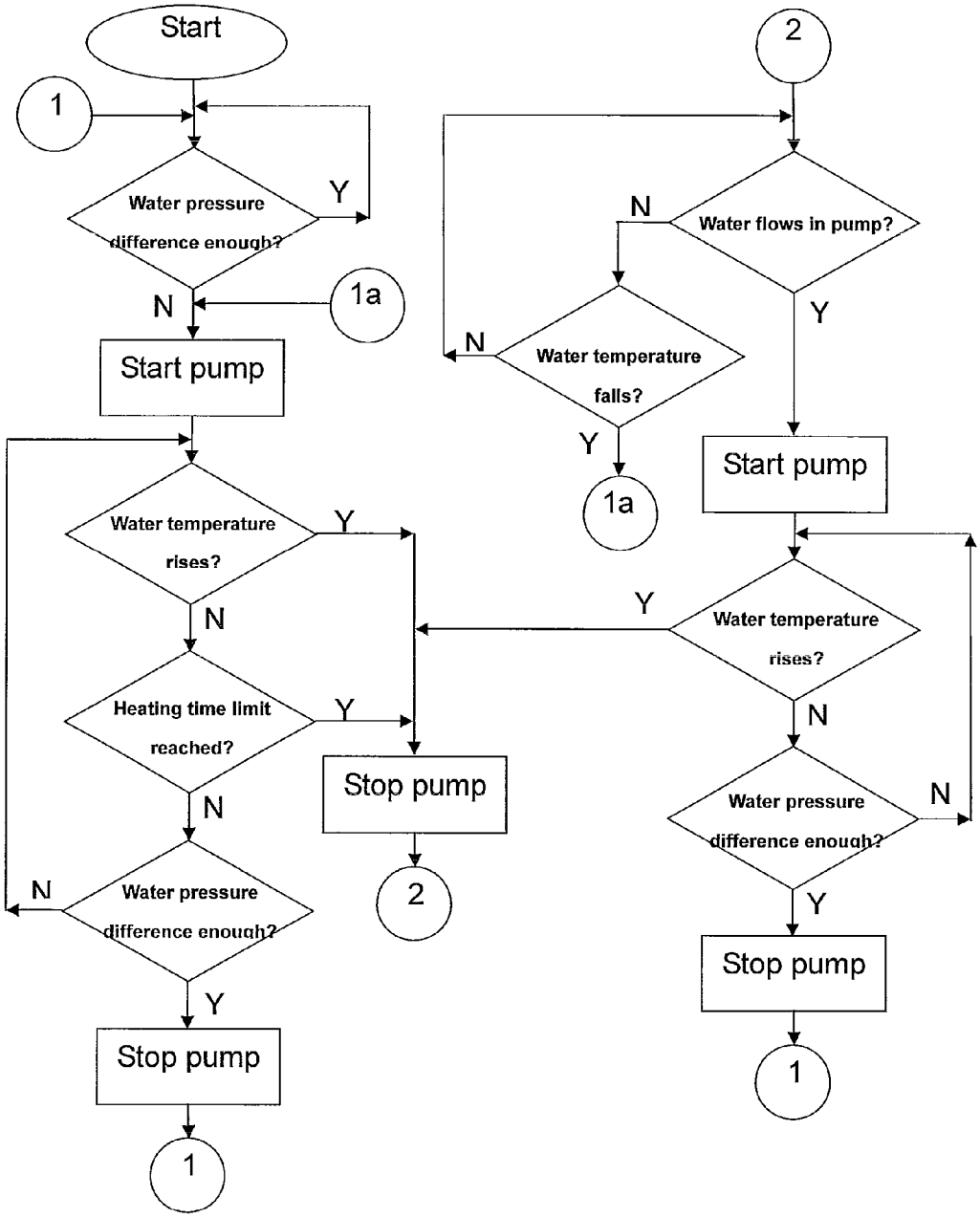
FIG. 2 is a functional flow chart of the pump control unit used by the preferred embodiment of the invention.

Referring to FIG. 2, the flowchart of the hot water system 1 is shown, first the system checks whether the water pressure difference is enough or not between the hot water pipes 12 and the cold water pipes 11, if not enough, the pump 14 will be started to increase the water pressure of the hot water pipes 12. At the same time the system will check whether the water temperature is rising or not, when the water temperature rises to a preset temperature, the system will stop the pump 14. If the water temperature is not rising, the system will count the pump 14's operation time and stop the pump 14 after a time limit is reached. Before the time limit the system will check the water pressure difference and the water temperature repeatedly until either one condition is met. After the time limit is reached or the water temperature is rising and the pump 14 is stopped, the system will then check for the water temperature drop and the water flow in the pump 14, if the water temperature has dropped or there is water flowing through the pump 14, the system will start the pump 14 again, and back to the previous process of checking the water pressure difference, water temperature and operation time limit.

Figure 3:
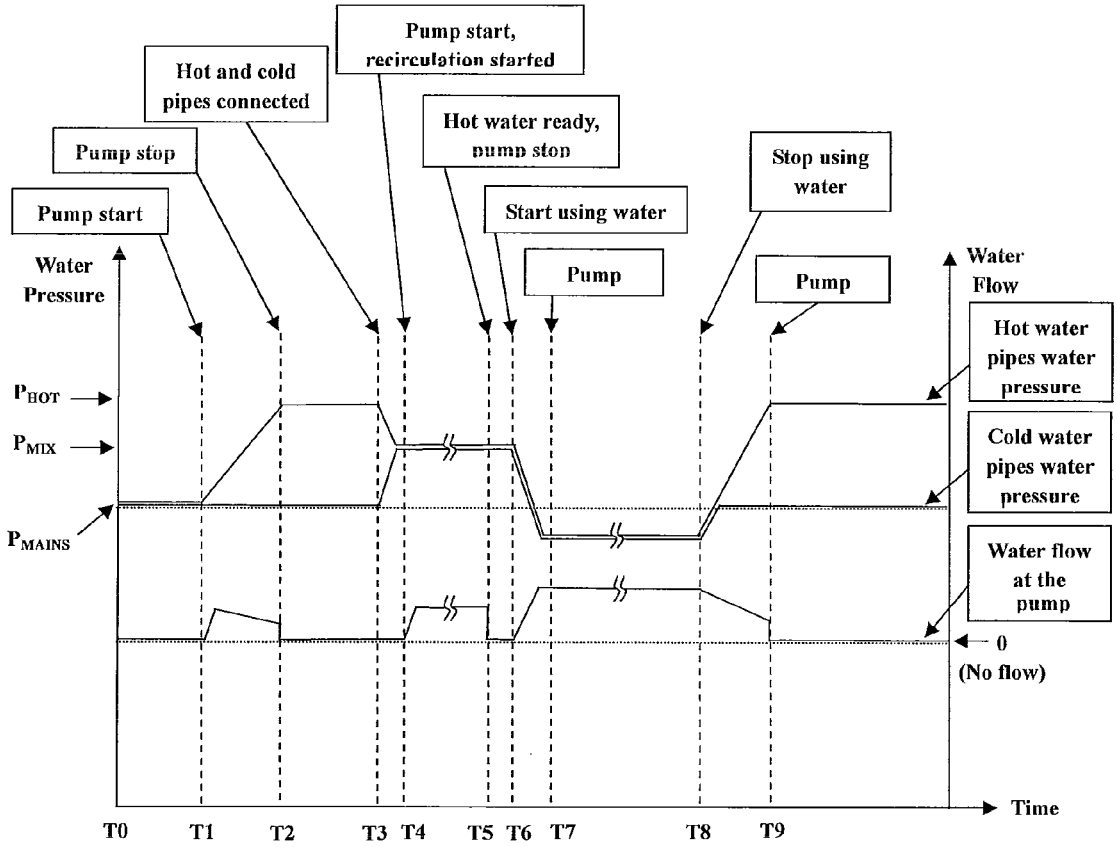
FIG. 3 is a water pressure and water flow chart of the hot water system according to the preferred embodiment of the invention.

Referring to FIG. 3, the water pressure change in the cold water pipes and the hot water pipes are shown. At time $T_1$ the pump 14 is started and the hot water pipes 12's water pressure is increased. At time $T_2$ the pump 14 is stopped and the hot water pipes 12's water pressure is kept at $P_{HOT}$. At $T_3$, the hot water pipes 12 and the cold water pipes 11 are connected and the water pressure of both will become $P_{MIX}$. At time $T_4$ the pump 14 is started to run the heating recirculation, and the water temperature in the hot water pipes rises. At time $T_5$ the heating process is completed and the pump 14 is stopped. At $T_6$ the user start to use the water by opening the faucet, and the water in the hot water pipes 12 and the cold water pipes 11 starts to flow out of the faucet, and the water pressure in both pipes will drop. After detecting the water flow at $T_7$ the pump 14 is started again to pump water into the hot water pipes 12 until time $T_8$ the faucet is closed, and time $T_9$ when the water pressure reaches $P_{HOT}$, the pump 14 is stopped.

Figure 4:
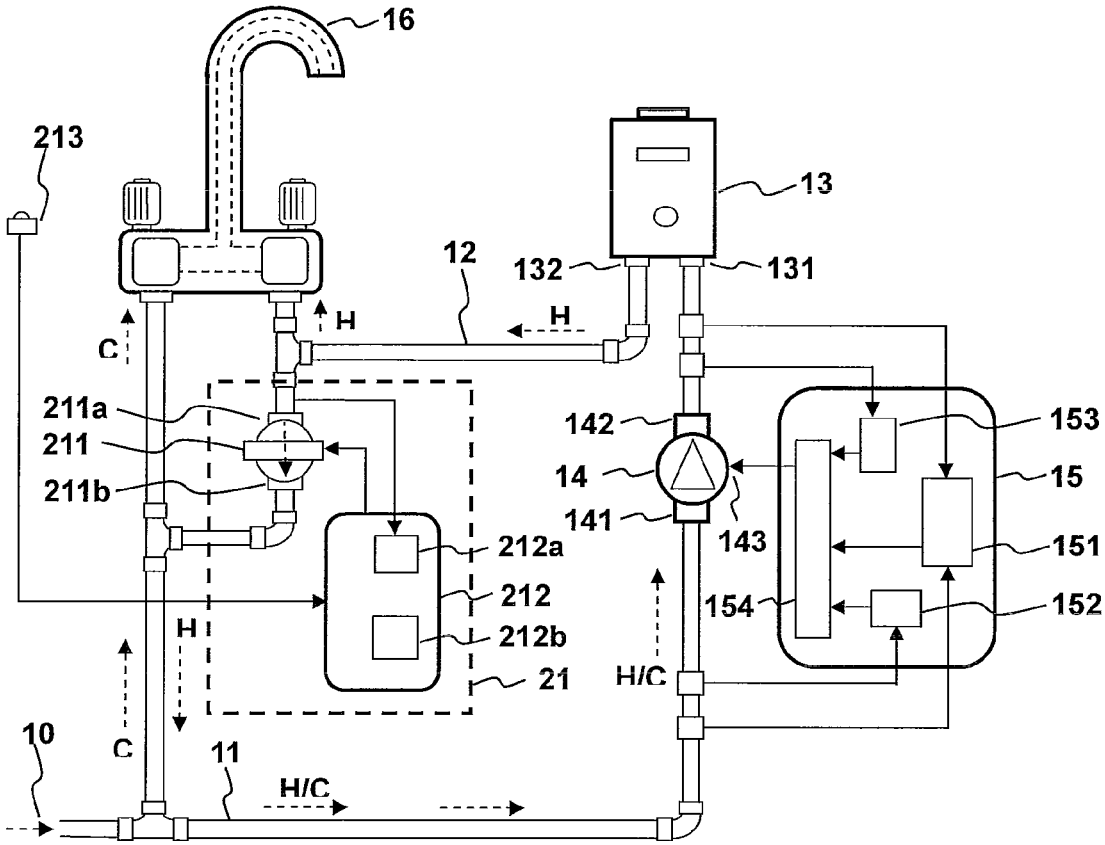
FIG. 4 is another system diagram of a hot water system according to the preferred embodiment of the invention.

Referring to FIG. 4, the hot water system of the invention, in comparison to the system in FIG. 1, further consists of a terminal control valve unit 21. The terminal control valve unit 21 has a valve 211, a water inlet 211*a*, a water outlet 211*b* and a button 213, a valve controller 212. The valve controller 212 has a water temperature detector 212*a* and a timer 212*b*.

Referring to FIG. 4, the water inlet 211*a* of the terminal control valve unit 21 connects to the hot water pipes 12, the water outlet 211*b* connects to the cold water pipes 11, the water temperature detector 212*a* connects to the hot water pipes 12, the button 213 connects to the valve controller 212, and the output of the valve controller 212 connects to the valve 211. In normal condition the valve 211 is closed and the hot water pipes 12 and cold water pipes 11 are isolated. When the user wants to use hot water, the button 213 is pressed by the user and makes the valve controller 212 to open the valve 211, the hot water pipes 12 and cold water pipes 11 are connected through the valve 211, as a result the water pressure difference between the hot water pipes 12 and the cold water pipes 11 is decreased, when the pump control unit 15 detects the decrease in the water pressure difference, the pump 14 will be started to recirculate the water in the pipes, when the water is heated by the water heater 13 and flows back to the terminal control valve unit 21, the water temperature detector 212*a* will detect the water temperature change, accordingly the valve controller 212 will close the valve 211, as the recirculation path is closed by the valve 211, the water pressure in the hot water pipes 12 will rise, so the water pressure difference between the hot water pipes 12 and the cold water pipes 11 will increase, finally when the water pressure difference has reached to a certain level, the pump control unit 15 will stop the pump 14, the recirculation process is completed and the hot water is now ready to use.

In summary, the hot water system of the invention has the following advantages of:

1. It uses the existing piping system, which makes it applicable to every existing house.
2. It uses the water pressure difference change to detect the user command, no extra or remote controller needed.
3. It can use the existing mix faucets to form the recirculation path, which is very simple, low cost and accessible at every end facilities.
4. It saves the waiting time and the water.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A hot water system comprising:

a hot water pipe;

a cold water pipe;

a faucet, which has a hot water inlet, a cold water inlet and a water outlet, the hot water inlet connects to the hot water pipe, the cold water inlet connects to the cold water pipe;

a water heater;

a pump, which is connected with the water heater in series between the cold water pipe and the hot water pipe, and increases the water pressure in the hot water pipe and makes the water pressure in the hot water pipe higher than the water pressure in the cold water pipe;

a water pressure detector, which detects the water pressure difference between a pump inlet and a pump outlet of the pump to decide whether the cold water pipe and the hot water pipe are connected, the pump starts when the water pressure difference is smaller than a predefined value, and the pump stops when the water pressure difference is larger than a predefined value; and a connecting unit, which connects the hot water pipe and the cold water pipe to let the hot water in the hot water pipe flow through the cold water pipe and back to the pump.

2. The hot water system of claim 1, wherein the said connecting unit is an outlet control valve which stops the water from flowing out of the said faucet, and forces the water from the said hot water pipe to flow through the said faucet into the said cold water pipe and back to the said pump when the said pump is pumping.

3. The hot water system of claim 2, wherein the said faucet is a mix faucet which has a hot water control valve, a cold water control valve and a water mix chamber, when the hot water control valve and the cold water control valve are opened, the water in the said cold water pipe and the said hot water pipe will flow into the water mix chamber, and when the said outlet control valve is closed, the said cold water pipe and the said hot water pipe are connected.

4. The hot water system of claim 2, further comprises: a water temperature detector, which detects the water temperature at the said outlet control valve and opens the said outlet control valve when the water temperature rises.

5. The hot water system of claim 1, when the hot water in the said hot water pipe flows back to the said pump, the said pump stops.

6. The hot water system of claim 1, the said pump has a check valve to control the water flow, and when the said pump is stopped, the water can flow from the said pump's inlet to the said pump's outlet.

7. The hot water system of claim 1, further comprises: a water temperature detector, which detects the water temperature at the said pump and stops the said pump when the water temperature rises.

8. The hot water system of claim 1, further comprises: a water temperature detector, which detects the water temperature at the said pump and starts the said pump when the water temperature drops.

9. The hot water system of claim 1, further comprises: a water flow detector, which detects the water flow in the said pump when the pump is stopped, and starts the said pump when a water flow in the pump is detected.

10. The hot water system of claim 1, further comprises: a timer, which can stop the said pump after the said pump operates over a preset time length.

11. The hot water system of claim 1, wherein the said connecting unit is a controlled valve unit, which is installed between the said hot water pipe and the said cold water pipe to control the water flowing from the said hot water pipe into the said cold water pipe and back to the said pump.

12. The hot water system of claim 11, wherein the said controlled valve unit comprising: a valve, which controls the connection between the said hot water pipe and the said cold water pipe.

13. The hot water system of claim 12, wherein the said controlled valve unit further comprises: a valve controller, which closes the said valve to stop water from flowing out of the said hot water pipe and let the water pressure in the said hot water pipe to increase.

14. The hot water system of claim 13, wherein the said controlled valve unit has a water temperature detector, when the detected water temperature is rising, the said valve controller will close the valve.

15. The hot water system of claim 13, wherein the said controlled valve unit has a timer, which can control the open and close time of the said valve.

16. The hot water system of claim 13, wherein the said controlled valve unit has a timer, which controls the time length of opening of the said valve.

17. The hot water system of claim 1, further comprising a timer and a temperature detector, wherein when the said hot water pipe and the said cold water pipe are connected and the said pump starts to pump, the said water heater first outputs warm water to an outlet of the water heater with a preset temperature and the timer starts, the temperature detector detects the water temperature at the said heater's inlet, and when the warm water flows back to the said heater's inlet and is detected by the temperature detector, the timer is stopped, thus the timer records a traveling time that the warm water flows from the said water heater's outlet to the said water heater's inlet, after the traveling time has transpired the said water heater starts to output hot water with high temperature.

18. The hot water system of claim 17, wherein the said warm water's traveling time is used to calculate and set the operation time length of the said pump.

19. The hot water system of claim 1, wherein the water outlet is stopped to form a closed channel for connecting the cold water pipe and hot water pipe through the faucet so to form a recirculation path, the water heater has a water heater inlet and a water heater outlet, the water heater inlet is connected to the pump outlet, the water heater outlet is connected to the hot water pipe, and the pump inlet is connected to the cold water pipe.

* * * * *